US008471657B1

(12) United States Patent
Shea et al.

(10) Patent No.: US 8,471,657 B1
(45) Date of Patent: Jun. 25, 2013

(54) TRIP MECHANISM AND ELECTRICAL SWITCHING APPARATUS INCLUDING A TRIP MEMBER PUSHED BY PRESSURE ARISING FROM AN ARC IN AN ARC CHAMBER

(75) Inventors: John J. Shea, Pittsburgh, PA (US); Brian J. Schaltenbrand, Pittsburgh, PA (US); Mark A. Janusek, Pittsburgh, PA (US)

(73) Assignee: Eaton Corporation, Cleveland, OH (US)

( * ) Notice: Subject to any disclaimer, the term of this patent is extended or adjusted under 35 U.S.C. 154(b) by 22 days.

(21) Appl. No.: 13/312,364

(22) Filed: Dec. 6, 2011

(51) Int. Cl.
*H01H 9/30* (2006.01)

(52) U.S. Cl.
USPC ..... 335/201

(58) Field of Classification Search
USPC ..... 335/201
See application file for complete search history.

(56) References Cited

U.S. PATENT DOCUMENTS

| | | | | |
|---|---|---|---|---|
| 5,103,198 | A * | 4/1992 | Morel et al. | 335/6 |
| 7,094,986 | B2 | 8/2006 | Shea | |
| 7,115,830 | B1 | 10/2006 | Weister et al. | |
| 7,368,677 | B2 | 5/2008 | Jones et al. | |
| 7,474,179 | B2 | 1/2009 | Weister et al. | |
| 7,488,915 | B2 | 2/2009 | Pollitt et al. | |
| 7,497,122 | B2 * | 3/2009 | Montesclaros et al. | 73/700 |
| 7,521,645 | B2 | 4/2009 | Shea et al. | |
| 7,598,467 | B2 | 10/2009 | Gibson et al. | |
| 8,063,334 | B2 * | 11/2011 | Dahl | 218/114 |
| 2006/0077023 | A1 | 4/2006 | Oh | |
| 2009/0194510 | A1 * | 8/2009 | Dahl | 218/46 |
| 2011/0062006 | A1 | 3/2011 | Gottschalk et al. | |

FOREIGN PATENT DOCUMENTS

| | | | |
|---|---|---|---|
| DE | 10 2009 010 900 | A1 | 9/2010 |
| EP | 0 455 564 | A1 | 11/1991 |
| WO | 2011/073540 | A1 | 6/2011 |

OTHER PUBLICATIONS

European Patent Office, International Search Report and Written Opinion, Nov. 29, 2012, 10 pp.

* cited by examiner

*Primary Examiner* — Elvin G Enad
(74) *Attorney, Agent, or Firm* — Eckert Seamans Cherin & Mellott, LLC; Kirk D. Houser

(57) ABSTRACT

An electrical switching apparatus includes separable contacts, an operating mechanism structured to open and close the separable contacts, and a trip mechanism cooperating with the operating mechanism to trip open the separable contacts. The trip mechanism includes a trip latch, and an arc chamber operatively associated with the separable contacts. The arc chamber includes a plurality of arc plates and a barrier disposed between the arc plates and the trip latch. The barrier has an opening therein. A trip member is disposed in or about the opening of the barrier of the arc chamber. During interruption of current flowing through the separable contacts, pressure arising from an arc in the arc chamber pushes the trip member away from the barrier of the arc chamber to engage the trip latch and cause the trip mechanism to trip open the separable contacts.

11 Claims, 5 Drawing Sheets

TRIP MECHANISM AND ELECTRICAL SWITCHING APPARATUS INCLUDING A TRIP MEMBER PUSHED BY PRESSURE ARISING FROM AN ARC IN AN ARC CHAMBER

BACKGROUND

1. Field

The disclosed concept relates generally to electrical switching apparatus and, more particularly, to electrical switching apparatus, such as circuit breakers. The disclosed concept also relates to trip mechanisms for electrical switching apparatus.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism which opens electrical contact assemblies to interrupt the flow of current through the conductors of an electrical system in response to such fault conditions as detected, for example, by a trip mechanism, such as a trip unit.

Latches are an important part of electrical switching apparatus, such as circuit breakers. A latch assembly typically includes three components: a pivotable D-shaft, a latch plate and a latch shaft. The latch plate and the latch shaft are suitably joined together and the latch plate rotates about a longitudinal axis of the latch shaft. The D-shaft blocks or allows movement of the latch plate through a D-shaft slot when in a corresponding suitable axial position as the D-shaft rotates on its longitudinal axis. The latch shaft and the D-shaft both rotate about their respective longitudinal axes, which are disposed a fixed distance apart. The latch assembly can only rotate when the D-shaft is suitably oriented to allow the latch plate to pass through the D-shaft slot. The D-shaft can include a number of arms for interface, for example, by a trip plunger of a trip solenoid that is energized in response to a trip condition, as detected by the trip unit.

During an interruption event, the trip latch load is increased during excessive current flow because of magnetic forces generated on the operating mechanism and the movable contact arms. These magnetic forces translate to the operating mechanism and create the need for relatively higher trip latch forces. For example, sometimes the contact carrier can begin to open prior to the trip unit tripping the circuit breaker. In other words, the magnetic forces lift the contact carrier and require an additional latch force to trip open the operating mechanism. As a result, during a relatively high fault current, the trip solenoid must either have sufficient operating force to operate the trip latch lever, or the desired trip might be delayed or inhibited, which would be completely undesirable.

There is room for improvement in electrical switching apparatus.

There is also room for improvement in trip mechanisms for electrical switching apparatus.

SUMMARY

These needs and others are met by embodiments of the disclosed concept where a trip member is disposed in an opening of a barrier of an arc chamber. During interruption of current flowing through separable contacts, pressure arising from an arc in the arc chamber pushes the trip member away from the barrier of the arc chamber to engage a trip latch and cause a trip mechanism to trip open the separable contacts.

In accordance with aspects of the disclosed concept, an electrical switching apparatus comprises: separable contacts; an operating mechanism structured to open and close the separable contacts; a trip mechanism cooperating with the operating mechanism to trip open the separable contacts, the trip mechanism comprising a trip latch; an arc chamber operatively associated with the separable contacts, the arc chamber comprising a plurality of arc plates and a barrier disposed between the arc plates and the trip latch, the barrier having an opening therein; and a trip member disposed in or about the opening of the barrier of the arc chamber, wherein during interruption of current flowing through the separable contacts, pressure arising from an arc in the arc chamber pushes the trip member away from the barrier of the arc chamber to engage the trip latch and cause the trip mechanism to trip open the separable contacts.

The opening may be a cylindrical opening; the trip member may be a cylindrical piston slidably positioned within the cylindrical opening; and gas pressure may arise from the arc in the arc chamber and push the cylindrical piston along the cylindrical opening to engage the trip latch.

During flow of the current through the separable contacts, a mechanical load on the trip latch may increase from magnetic forces generated on the operating mechanism by the flow of the current; and the cylindrical piston may be structured to overcome the mechanical load.

The trip member may be a piston aligned with the trip latch; and the piston may include a spring structured to return the piston to a seated position within the opening of the barrier after interruption of the current flowing through the separable contacts.

As another aspect of the disclosed concept, a trip mechanism is for an electrical switching apparatus comprising separable contacts, an operating mechanism structured to open and close the separable contacts, and an arc chamber operatively associated with the separable contacts, the arc chamber comprising a plurality of arc plates and a barrier. The trip mechanism comprises: an opening in the barrier of the arc chamber; a trip latch, the barrier being disposed between the arc plates and the trip latch; and a trip member disposed in or about the opening in the barrier of the arc chamber, wherein the trip mechanism cooperates with the operating mechanism to trip open the separable contacts, and wherein during interruption of current flowing through the separable contacts, pressure arising from an arc in the arc chamber pushes the trip member away from the barrier of the arc chamber to engage the trip latch and cause the trip mechanism to trip open the separable contacts.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

The disclosed concept is described in association with a circuit breaker, although the disclosed concept is applicable to a wide range of electrical switching apparatus.

Figure 1:
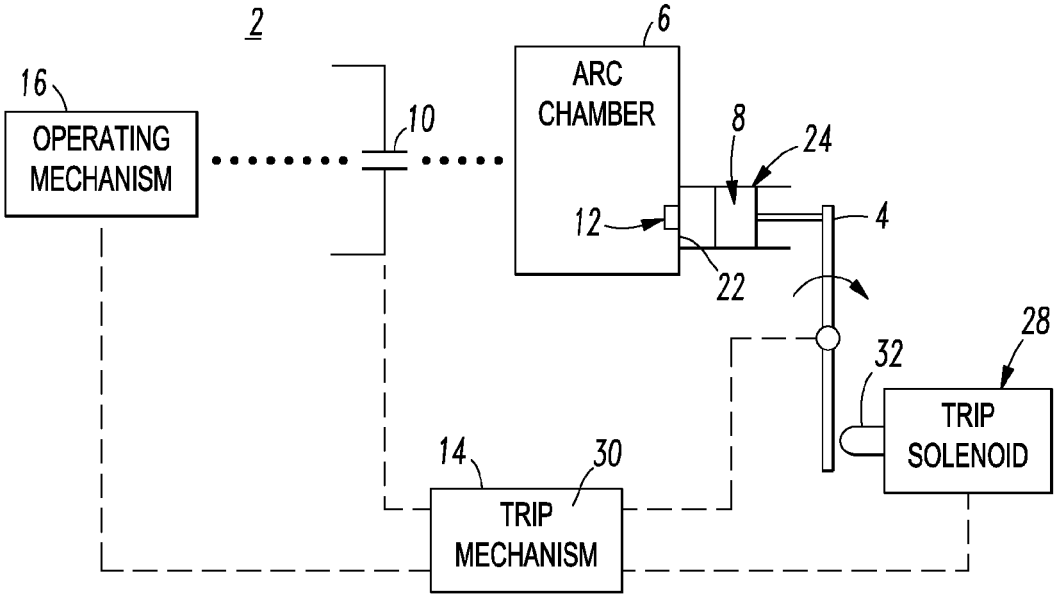
FIG. 1 is a block diagram of a circuit interrupter including a trip latch lever, an arc chamber and a trip member in a non-tripped position in accordance with embodiments of the disclosed concept.
Figure 2:
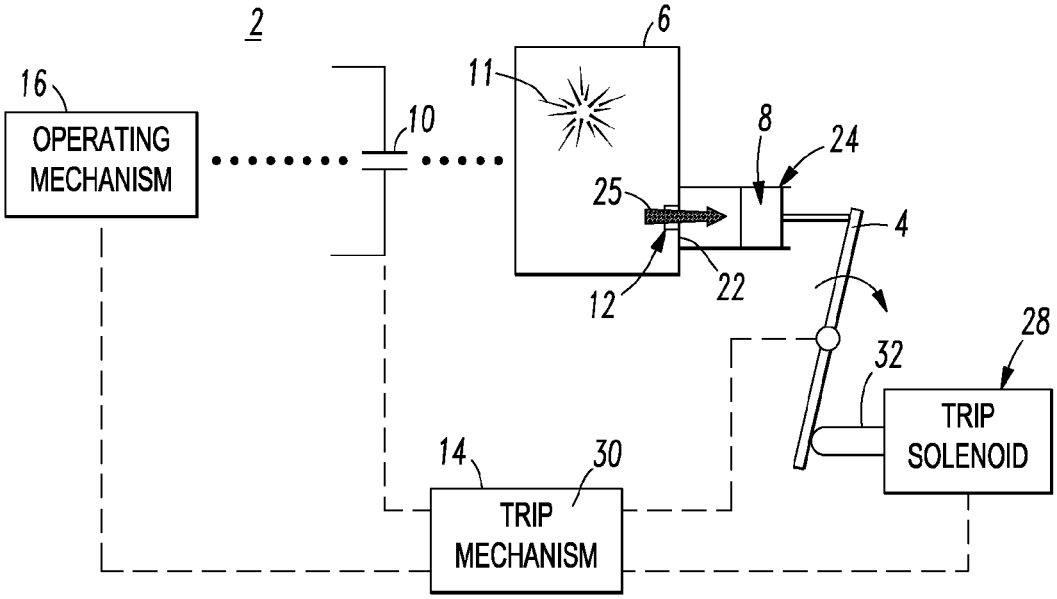
FIG. 2 is a block diagram of the circuit interrupter of FIG. 1 with the trip member and the trip latch lever in a tripped position.

Referring to FIGS. 1 and 2, an electrical switching apparatus, such as a circuit interrupter (e.g., without limitation, the example circuit breaker 2), includes a trip latch, such as the example trip latch lever 4, an arc chamber 6 and a trip member 8 shown in respective non-tripped and tripped positions. During interruption of current flowing through separable contacts 10 of the circuit breaker 2, pressure arising from an arc 11 (FIG. 2) in the arc chamber 6 pushes the trip member 8 through an opening 12 of the arc chamber 6 to engage and rotate (e.g., without limitation, clockwise with respect to FIG. 2) the trip latch lever 4 and cause a trip mechanism 14 to trip open the separable contacts 10.

As is conventional, the example circuit breaker 2 includes an operating mechanism 16 structured to open and close the separable contacts 10, and the trip mechanism 14 cooperating with the operating mechanism 16 to trip open the separable contacts 10. The trip mechanism 14 includes the trip latch lever 4. The arc chamber 6 is operatively associated with the separable contacts 10 and includes a plurality of arc plates (not shown, but see the arc chamber 62 and the plurality of arc plates 20 of FIG. 7) and a barrier 22 disposed between the arc plates (not shown) and the trip latch lever 4.

In accordance with aspects of the disclosed concept, the barrier 22 has the opening 12 therein and forms a cylindrically shaped port 24. The trip member 8, which can have, for example and without limitation, a shape resembling a piston, is disposed in the port 24. The trip member 8 is suitably aligned with the trip latch lever 4. During interruption of current flowing through the separable contacts 10, gas pressure 25 arising from the arc 11 in the arc chamber 6 pushes the trip member 8 away from the barrier 22 to engage the trip latch lever 4 and cause the trip mechanism 14 to trip open the separable contacts 10. Preferably, a spring (not shown, but see spring 26 of FIGS. 3 and 4) is employed to return the trip member 8 to a seated (or relaxed state) position as shown in FIG. 1 after the gas pressure 25 is released.

As is also conventional, the trip mechanism 14 further includes a trip solenoid 28 and a trip circuit 30 structured to sense the current flowing through the separable contacts 10 and responsively energize the trip solenoid 28. The trip solenoid 28 includes a plunger 32 structured to engage the trip latch lever 4 and cause the trip mechanism 14 to trip open the separable contacts 10.

Figure 3:
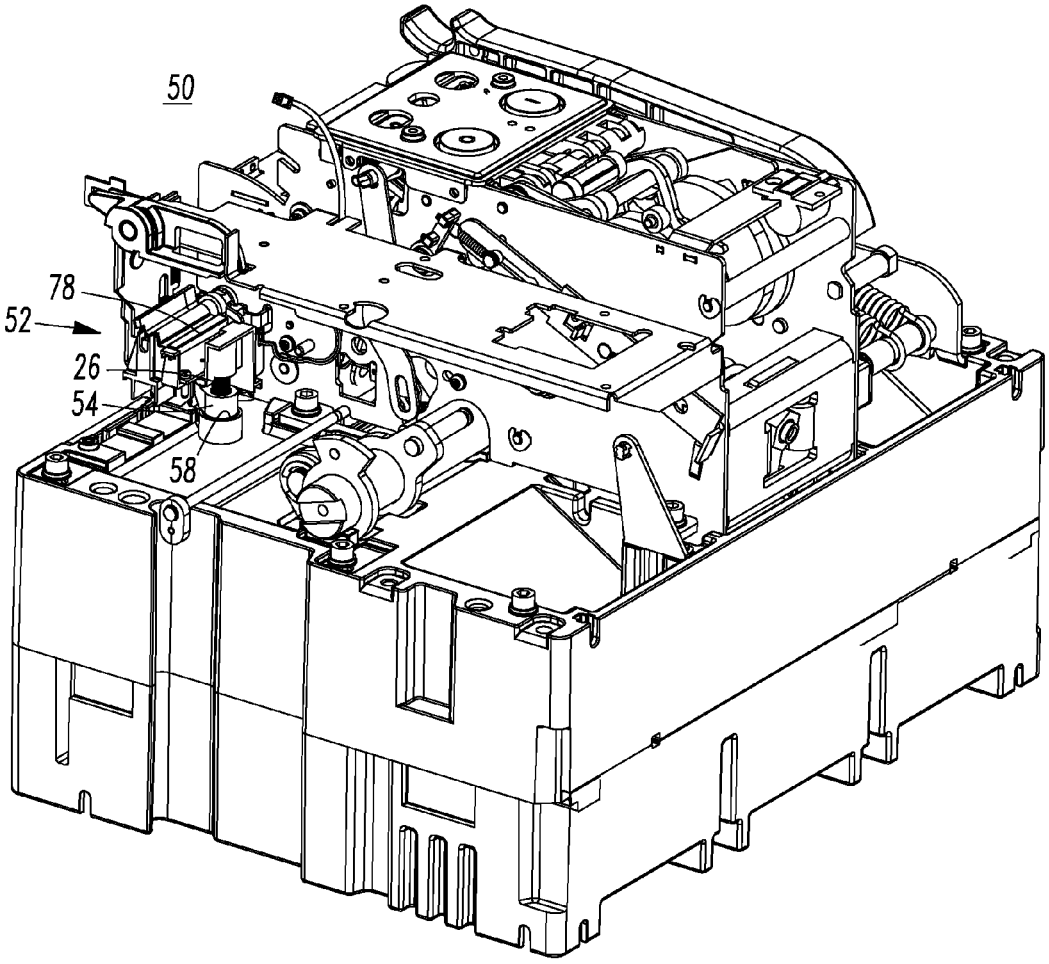
FIG. 3 is an isometric view of a circuit interrupter including a trip latch lever and a trip member in a non-tripped position in accordance with another embodiment of the disclosed concept.
Figure 4:
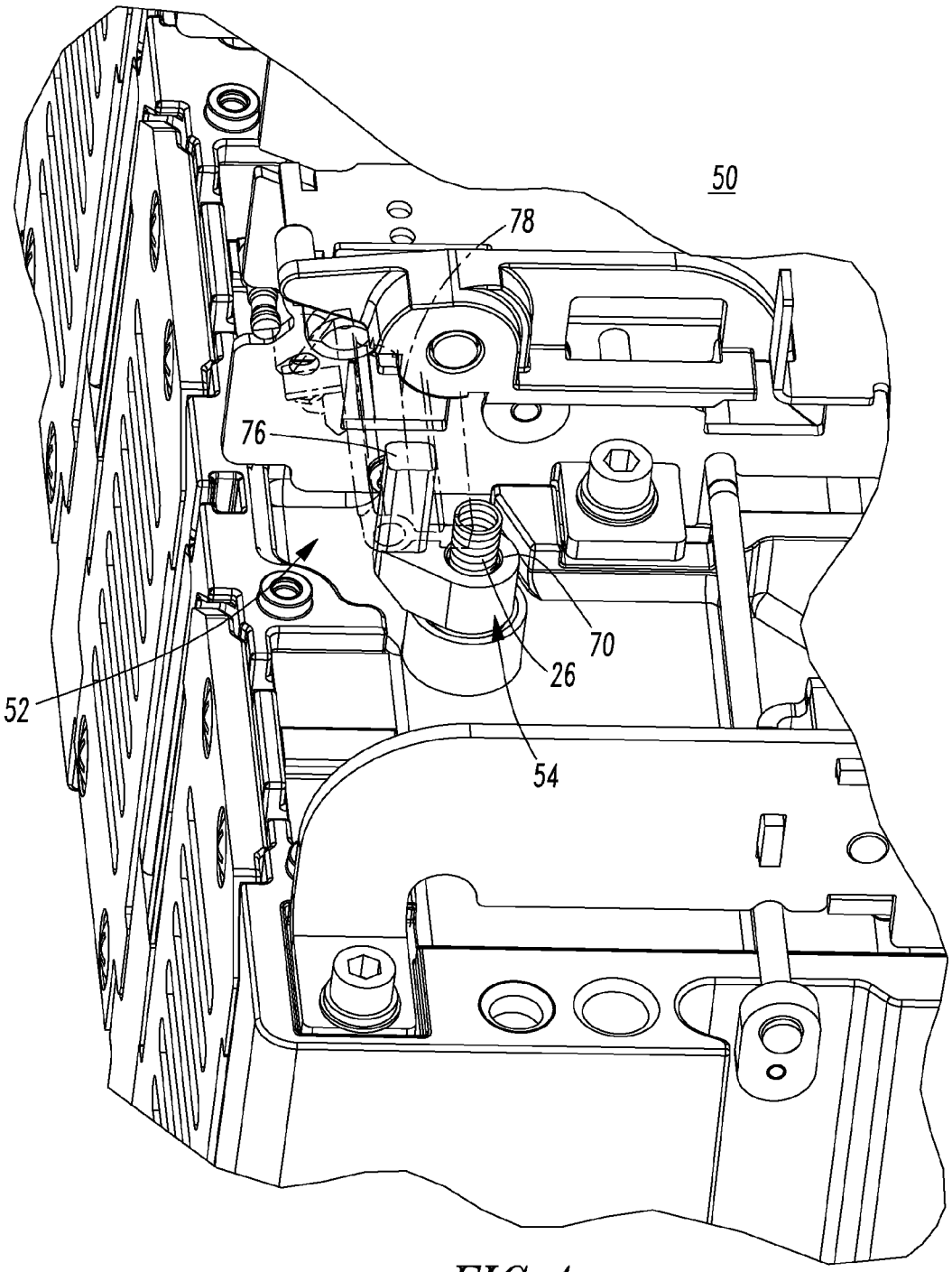
FIG. 4 is a relatively more detailed isometric view of the circuit interrupter of FIG. 3.

FIGS. 3 and 4 show another electrical switching apparatus, such as the example circuit interrupter 50, including a trip latch lever 52 and a trip member 54 in a non-tripped position. In this example, the trip member 54 is shaped like a piston and is suitably aligned with the trip latch lever 52. The trip member 54 includes the spring 26 structured to return the trip member 54 to a seated (or relaxed) position (as shown in FIGS. 3 and 4) within an example cylindrically shaped opening 58 of a barrier 60 (FIG. 7) of an arc chamber 62 (FIG. 7) after interruption of current flowing through separable contacts 64.

Figure 5:
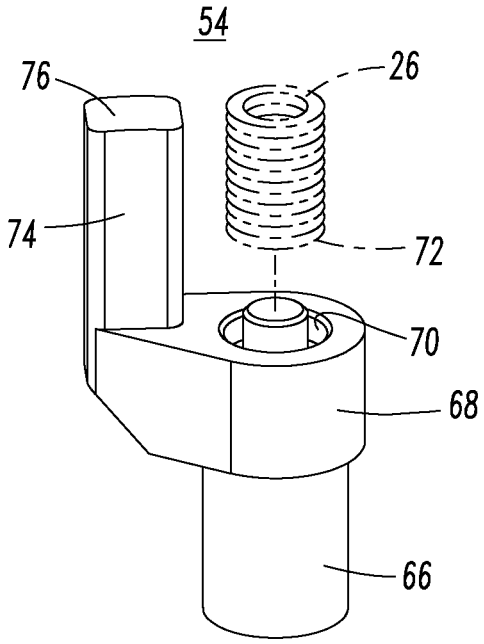
FIGS. 5 and 6 are isometric views of the trip member of FIG. 3.
Figure 6:
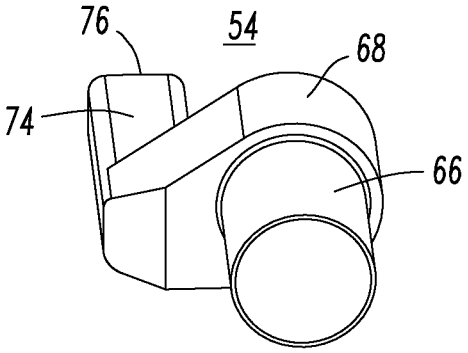

As shown in FIGS. 5 and 6, the trip member 54 includes a first portion 66 having a cylindrical shape (e.g., without limitation, shaped like a piston) structured to be guided by the cylindrically shaped opening 58, a second portion 68 having a recess 70 to accept one end 72 (shown in phantom line drawing in FIG. 5; shown in FIG. 7) of the spring 26, and a third portion 74 offset from the first portion 66 and extending from the second portion 68. The third portion 74 has an end 76 that engages an arm 78 (FIGS. 3 and 4) of the trip latch lever 52 (FIGS. 3 and 4).

Figure 7:
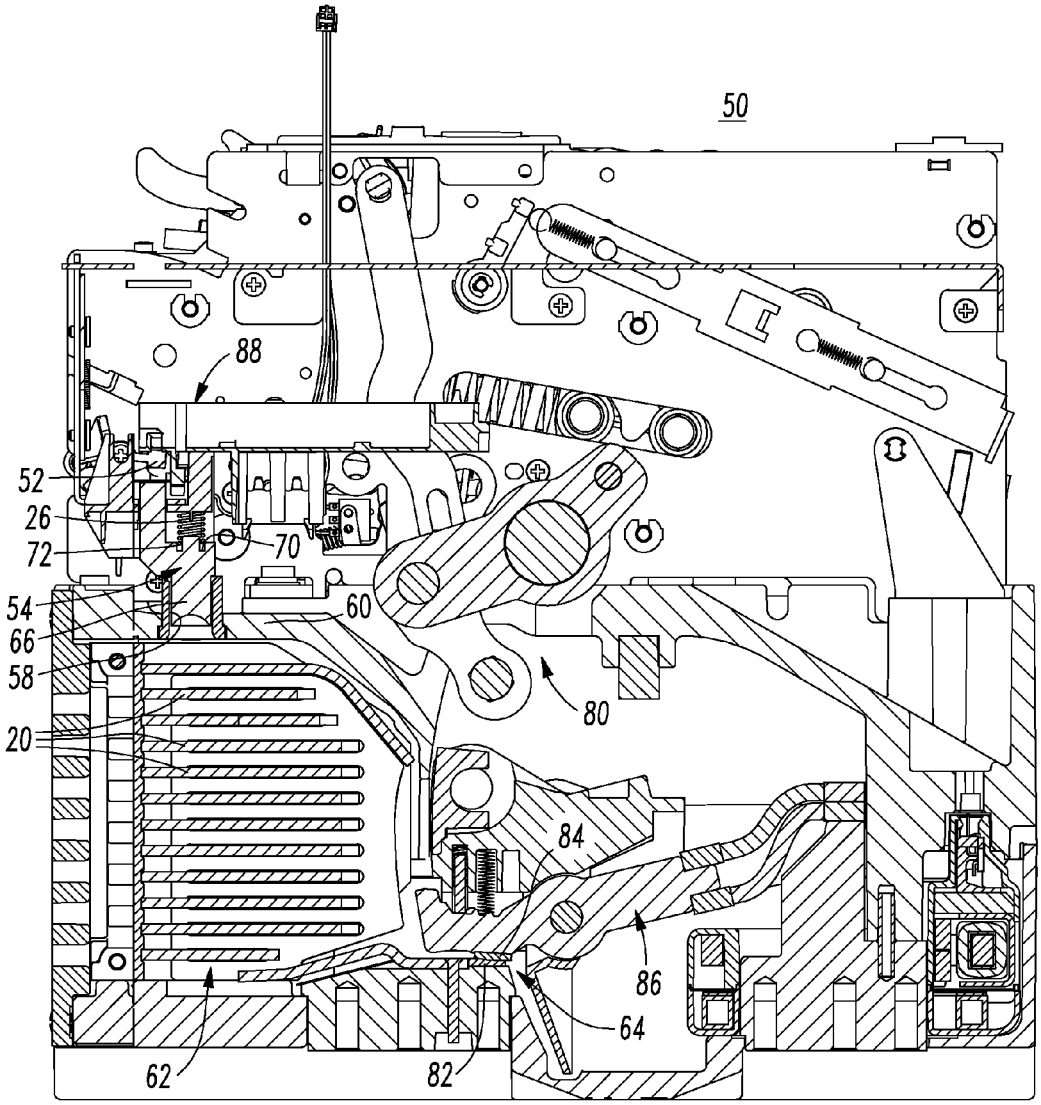
FIG. 7 is a vertical elevation cross sectional view of the circuit interrupter of FIG. 3 showing the trip member and the arc chamber thereof.

FIG. 7 shows the trip member 54, the cylindrically shaped opening 58 and the arc chamber 62. The first portion 66 is slidably positioned within the cylindrically shaped opening 58. Gas pressure arising from an arc (not shown but see the arc 11 of FIG. 2) in the arc chamber 62 pushes the cylindrically shaped first portion 66 along the cylindrically shaped opening 58 to engage the trip latch lever 52.

During flow of current through the separable contacts 64, a mechanical load on the trip latch lever 52 increases from magnetic forces generated on operating mechanism 80 by the flow of the current. The trip member 54, as moved by the gas pressure arising from the arc in the arc chamber 62 against the force of the spring 26 (FIGS. 3, 4 and 7) is structured to overcome the increased mechanical load on the trip latch lever 52.

The separable contacts 64 include a fixed contact 82 and a movable contact 84. The operating mechanism 80 includes a contact carrier 86 carrying the movable contact 84. Prior to interruption of the current flowing through the separable contacts 64, a magnetic force arising from the current lifts the contact carrier 86 and causes a mechanical load on the trip latch lever 52, which requires additional force from the trip member 54 to cause a trip mechanism 88, when released by the trip latch lever 52, to trip open the separable contacts 64.

A non-limiting example of a circuit breaker including a D-shaft, which can be rotated by the disclosed trip latch lever 52, and a latch mechanism is disclosed by U.S. Patent Application Publication No. 2011/0062006, which is incorporated by reference herein.

The disclosed arc pressure assisted trip members 8,54 preferably provide sufficient tripping force to independently ensure that the corresponding electrical switching apparatus 2,50 does trip.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof

What is claimed is:

1. An electrical switching apparatus comprising:

separable contacts;

an operating mechanism structured to open and close said separable contacts;

a trip mechanism cooperating with said operating mechanism to trip open said separable contacts, said trip mechanism comprising a trip latch;

an arc chamber operatively associated with said separable contacts, said arc chamber comprising a plurality of arc plates and a barrier disposed between said arc plates and said trip latch, said barrier having an opening therein; and a trip member disposed in or about the opening of the barrier of said arc chamber, wherein during interruption of current flowing through said separable contacts, pressure arising from an arc in said arc chamber pushes said trip member away from the barrier of said arc chamber to engage the trip latch and cause said trip mechanism to trip open said separable contacts;

wherein said trip member comprises a spring structured to return said trip member to a seated position within the opening of said barrier after interruption of said current flowing through said separable contacts, a first portion having a shape guided by the opening, a second portion having a recess accepting an end of said spring, and a third portion offset from the first portion and extending from the second portion; and wherein gas pressure arising from the arc in said arc chamber pushes said first portion along the opening to cause the third portion to engage said trip latch lever.

2. The electrical switching apparatus of claim 1 wherein said opening is a cylindrical opening; wherein said trip member is a cylindrical piston slidably positioned within said cylindrical opening; and wherein gas pressure arising from the arc in said arc chamber pushes said cylindrical piston along the cylindrical opening to engage the trip latch.

3. The electrical switching apparatus of claim 2 wherein during flow of said current through said separable contacts, a mechanical load on said trip latch increases from magnetic forces generated on said operating mechanism by said flow of said current; and wherein said cylindrical piston is structured to overcome said mechanical load.

4. The electrical switching apparatus of claim 1 wherein said trip mechanism further comprises a trip solenoid and a trip circuit structured to sense the current flowing through said separable contacts and energize the trip solenoid; and wherein said trip solenoid comprises a plunger structured to engage said trip latch and cause said trip mechanism to trip open said separable contacts.

5. The electrical switching apparatus of claim 1 wherein said separable contacts comprise a fixed contact and a movable contact; wherein said operating mechanism comprises a contact carrier carrying said movable contact; and wherein prior to interruption of said current flowing through said separable contacts a magnetic force arising from said current lifts the contact carrier and causes a mechanical load on said trip latch, which requires additional force from said trip member to cause said trip mechanism to trip open said separable contacts.

6. The electrical switching apparatus of claim 1 wherein said trip member is a piston aligned with said trip latch; and wherein said piston includes a spring structured to return said piston to a seated position within the opening of said barrier after interruption of said current flowing through said separable contacts.

7. The electrical switching apparatus of claim 1 wherein said electrical switching apparatus is a circuit interrupter.

8. The electrical switching apparatus of claim 7 wherein said circuit interrupter is a circuit breaker.

9. An electrical switching apparatus comprising:

separable contacts;

an operating mechanism structured to open and close said separable contacts;

a trip mechanism cooperating with said operating mechanism to trip open said separable contacts, said trip mechanism comprising a trip latch;

an arc chamber operatively associated with said separable contacts, said arc chamber comprising a plurality of arc plates and a barrier disposed between said arc plates and said trip latch, said barrier having an opening therein; and a trip member disposed in or about the opening of the barrier of said arc chamber, wherein during interruption of current flowing through said separable contacts, pressure arising from an arc in said arc chamber pushes said trip member away from the barrier of said arc chamber to engage the trip latch and cause said trip mechanism to trip open said separable contacts;

wherein said opening is a cylindrical opening; wherein said trip member comprises a spring structured to return said trip member to a seated position within the opening of said barrier after interruption of said current flowing through said separable contacts, a first portion having a cylindrical shape guided by the cylindrical opening, a second portion having a recess accepting an end of said spring, and a third portion offset from the first portion and extending from the second portion; and wherein gas pressure arising from the arc in said arc chamber pushes said first portion along the cylindrical opening to cause the third portion to engage said trip latch lever.

10. A trip mechanism for an electrical switching apparatus comprising separable contacts, an operating mechanism structured to open and close said separable contacts, and an arc chamber operatively associated with said separable contacts, said arc chamber comprising a plurality of arc plates and a barrier, said trip mechanism comprising:

an opening in the barrier of said arc chamber;

a trip latch, said barrier being disposed between said arc plates and said trip latch; and a trip member disposed in or about said opening in the barrier of said arc chamber, wherein said trip mechanism cooperates with said operating mechanism to trip open said separable contacts;

wherein during interruption of current flowing through said separable contacts, pressure arising from an arc in said arc chamber pushes said trip member away from the barrier of said arc chamber to engage the trip latch and cause said trip mechanism to trip open said separable contacts;

wherein said opening is a cylindrical opening;

wherein said trip member comprises a spring structured to return said trip member to a seated position within the opening of said barrier after interruption of said current flowing through said separable contacts, a first portion having a cylindrical shape guided by the cylindrical opening, a second portion having a recess accepting an end of said spring, and a third portion offset from the first portion and extending from the second portion, and wherein gas pressure arising from the arc in said arc chamber pushes said first portion along the cylindrical opening to cause the third portion to engage said trip latch lever.

11. A trip mechanism for an electrical switching apparatus comprising separable contacts, an operating mechanism structured to open and close said separable contacts, and an arc chamber operatively associated with said separable contacts, said arc chamber comprising a plurality of arc plates and a barrier, said trip mechanism comprising:

an opening in the barrier of said arc chamber;

a trip latch, said barrier being disposed between said arc plates and said trip latch; and a trip member disposed in or about said opening in the barrier of said arc chamber, said trip member comprising:

a spring structured to return said trip member to a seated position within the opening of said barrier after interruption of current flowing through said separable contacts, a first portion having a shape guided by the opening, a second portion having a recess accepting an end of said spring, and a third portion offset from the first portion and extending from the second portion, wherein gas pressure arising from the arc in said arc chamber pushes said first portion along the opening to cause the third portion to engage said trip latch lever;

wherein said trip mechanism cooperates with said operating mechanism to trip open said separable contacts; and wherein during interruption of said current flowing through said separable contacts, pressure arising from an arc in said arc chamber pushes said trip member away from the barrier of said arc chamber to engage the trip latch and cause said trip mechanism to trip open said separable contacts.

* * * * *